US010967535B2

(12) United States Patent
Dries et al.

(10) Patent No.: US 10,967,535 B2
(45) Date of Patent: Apr. 6, 2021

(54) METHOD OF ADJUSTING A PUNCH BODY ASSEMBLY

(71) Applicant: AMADA TOOL AMERICA, INC., Batavia, NY (US)

(72) Inventors: Edward A. Dries, Le Roy, NY (US); Jeffrey Tauscher, Basom, NY (US)

(73) Assignee: Amada Tool America, Inc., Batavia, NY (US)

( * ) Notice: Subject to any disclaimer, the term of this patent is extended or adjusted under 35 U.S.C. 154(b) by 0 days.

(21) Appl. No.: 16/723,507

(22) Filed: Dec. 20, 2019

(65) Prior Publication Data

US 2020/0122351 A1 Apr. 23, 2020

Related U.S. Application Data

(62) Division of application No. 15/479,018, filed on Apr. 4, 2017, now Pat. No. 10,525,610.

(51) Int. Cl.
*B26F 1/14* (2006.01)
*B21D 28/34* (2006.01)

(52) U.S. Cl.
CPC ..... *B26F 1/14* (2013.01); *B21D 28/346* (2013.01)

(58) Field of Classification Search
CPC ..... B26F 1/14; B21D 28/346
See application file for complete search history.

(56) References Cited

U.S. PATENT DOCUMENTS

| | | | | |
|---|---|---|---|---|
| 5,020,407 | A | 6/1991 | Brinlee | |
| 5,839,341 | A | 11/1998 | Johnson | |
| 6,047,621 | A | 4/2000 | Dries et al. | |
| 6,142,052 | A | 11/2000 | Endo | |
| 6,276,247 | B1 | 8/2001 | Helda | |
| 7,156,009 | B2 * | 1/2007 | Iwamoto | B21D 28/12 83/686 |
| 7,168,356 | B2 | 1/2007 | Rosene et al. | |
| 7,658,134 | B2 | 2/2010 | Morgan | |
| 7,926,399 | B2 | 4/2011 | Huang | |
| 7,954,404 | B2 * | 6/2011 | Thielges | B21D 28/346 83/140 |
| 8,408,111 | B2 | 4/2013 | Johnston et al. | |
| 8,616,107 | B2 | 12/2013 | Kraft | |
| 8,714,065 | B2 | 5/2014 | Takahashi et al. | |
| 8,997,617 | B2 | 4/2015 | Thomson | |
| 2010/0206150 | A1 | 8/2010 | Kraft | |
| 2012/0199642 | A1 * | 8/2012 | Thielges | B21D 28/346 234/44 |
| 2014/0345435 | A1 | 11/2014 | Johnston | |
| 2019/0022740 | A1 * | 1/2019 | Branson | B21K 25/00 |

FOREIGN PATENT DOCUMENTS

| | | | |
|---|---|---|---|
| JP | 2002282963 | A | 10/2002 |
| JP | 2010179371 | A | 8/2010 |
| WO | WO 2014/189878 | A2 | 11/2014 |

* cited by examiner

*Primary Examiner* — Omar Flores Sanchez
(74) *Attorney, Agent, or Firm* — Blank Rome LLP

(57) ABSTRACT

A method of adjusting punch body assembly, that has a punch body coupled to a driver, by moving the driver with respect to the punch body until a select axial position is reached along the longitudinal axis of the punch body and locking the driver at the select axial position.

19 Claims, 4 Drawing Sheets

METHOD OF ADJUSTING A PUNCH BODY ASSEMBLY

RELATED APPLICATION

The present application is a divisional of application Ser. No. 15/479,018, filed on Apr. 4, 2017, the entire disclosure of which is incorporated herein by reference in its entirety.

FIELD OF THE INVENTION

The present invention relates to a punch body assembly for a punching tool. More specifically, the present invention relates to an adjustable punch body assembly and method of adjusting the same, that allows adjustment of the length of the punching tool.

BACKGROUND OF THE INVENTION

Punching tools are typically used for creating different sizes and shapes of indentations or cuts in a workpiece, such as sheet metal. Punching tools often wear down from use, however, and thus either re-machining, re-surfacing, or replacement of the tool is required.

A need exists for a punch body assembly for a punching tool that allows easy in-field adjustment of the length of the driver of the punching tool, thereby avoiding re-machining or replacement of the tool when it wears down.

SUMMARY OF THE INVENTION

Accordingly, the present invention may provide an adjustable punch body assembly and method of adjusting a punch body assembly that includes a punch body that has a driver engagement end and an opposite cutting end, and a longitudinal inner bore the extends between the driver engagement and cutting ends. The driver engagement end includes a first adjustable engagement. A driver is configured to adjustably couple to the punch body. The driver includes a base that has a second adjustable engagement corresponding to the first adjustable engagement of the punch body to establish an axial position of the driver with respect to the punch body on a longitudinal axis thereof. A stem extends from the base for mating with a punch head. A locking mechanism can be provided at the driver engagement end of the punch body for locking the axial position of the driver.

In certain embodiment, the driver is rotatably coupled to the driver engagement end of the punch body; the first adjustable engagement may comprise external threads on the driver engagement end of the punch body and the second adjustable engagement may comprise internal threads in the base of the driver that engage the external threads; an ejector member may be retained by the punch body; the ejector member may have a body that is spring biased at one end and an ejector extension at the other end; a spring may be disposed between the one end of the ejector member and the base of the driver; the locking mechanism may include a plurality of position bores disposed in the driver engagement end of the punch body; the plurality of position bores may be arranged annularly around an end face of the driver engagement end of the punch body; the base of the driver may include at least one locking hole that axially aligns with one of the plurality of position holes; at least one fastener may be received in the locking hole of the base and in the one of the plurality of position holes of the punch body for locking the driver in the axial position; and/or the cutting end of the punch body may include at least one external slot for aligning the punch body with a punching machine.

The present invention may also provide an adjustable punch body assembly, that comprises a punch body including a driver engagement end and an opposite cutting end, and a longitudinal inner bore extending between the driver engagement and cutting ends. A driver is configured to adjustably couple to the punch body. The driver includes a base and a stem extending from the base for mating with a punch head. Means are provided for adjusting an axial position of the driver with respect to the punch body on its longitudinal axis and means are provided for locking the axial position of the driver.

The present invention may yet further provide a method of adjusting a punch body assembly that has a punch body coupled to a driver, that comprises the steps of coupling a base of the driver to a driver engagement end of the punch body; moving the driver with respect to the punch body until a select axial position of the driver with respect to the punch body is reached along a longitudinal axis of the punch body; and locking the driver in the select axial position.

In some embodiments, the method further comprises the steps of unlocking the select axial position of the driver; and rotating the driver with respect to the punch body until another select axial position of the driver with respect to the punch body is reached along the longitudinal axis; and further comprises the step of locking the driver in the another select axial position. In an embodiment of the method, the step of coupling the driver to the punch body includes threadably coupling the base of the driver to the driver engagement end of the punch body.

In certain embodiments of the method, the step of moving the driver with respect to the punch body to the select axial position includes aligning one of a plurality of position bores in the driver engagement end of the punch body with a locking hole in the base of the driver; the step of moving the driver with respect to the punch body comprising rotating the driver with respect to the punch body to the select axial position; the plurality of position bores are arranged annularly around an end face of the driver engagement end of the punch body; the step of locking the driver at the select axial position includes inserting at least one fastener through the locking hole and into the one of plurality of position bores aligned with the locking hole; the method further comprises the step of unlocking the select axial position of the driver by removing the fastener from the locking hole; the method further comprises the step of, after the step of unlocking the select axial position of the driver, rotating the driver with respect to the punch body until another select axial position of the driver with respect to the punch body is reached along the longitudinal axis of the punch body; the step of rotating the driver with respect to the punch body to the another select axial position includes aligning another one of the plurality of position bores in the driver engagement end of the punch body with the locking hole in the base of the driver; the method further comprises the step of locking the driver at the another select axial position by inserting at least one fastener through the locking hole and through the another one of the plurality of position bores.

In other embodiments of the method, the step of coupling the base of the driver to the driver engagement end of the punch body comprises threadably coupling the base and the driver engagement end; an ejector member is retained by the punch body, the ejector member has a body that is spring biased at one end and has an ejector extension at the other end; and/or the method further comprises the step of aligning a cutting end of the punch body that is opposite of the driver engagement end with a punching machine.

The present invention may still further provide a method of adjusting a punch body assembly comprising a punch body coupled to a driver, that comprises the steps of threadably coupling a base of the driver to a driver engagement end of the punch body, the base having at least one locking hole and the driver engagement end having a plurality of position bores; rotating the driver with respect to the punch body until the locking hole aligns with one of the plurality of position bores thereby establishing a select axial position of the driver with respect to the punch body and along a longitudinal axis of the punch body; and locking the driver in the select axial position.

In some embodiments, the step of threadably coupling the driver and the punch body includes coupling internal threads of the base of the driver with external threads of the driver engagement end of the punch body; the step of locking the driver in the select axial position includes inserting at least one fastener through the locking hole and into the one of the plurality of position bores that is aligned with the locking hole; the method further comprises the step of unlocking the select axial position of the driver by removing the fastener from the locking hole; the method further comprises the steps of, after the step of unlocking the select axial position of the driver, rotating the driver with respect to the punch body until the locking hole aligns with another one of the plurality of position holes to establish another select axial position of the driver with respect to the punch body along the longitudinal axis thereof; and locking the driver in the another select axial position; and/or the step of locking the driver in the another select axial position includes inserting at least one fastener through the locking hole and into the another one of the plurality of position bores aligned with the locking hole.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Figure 1:
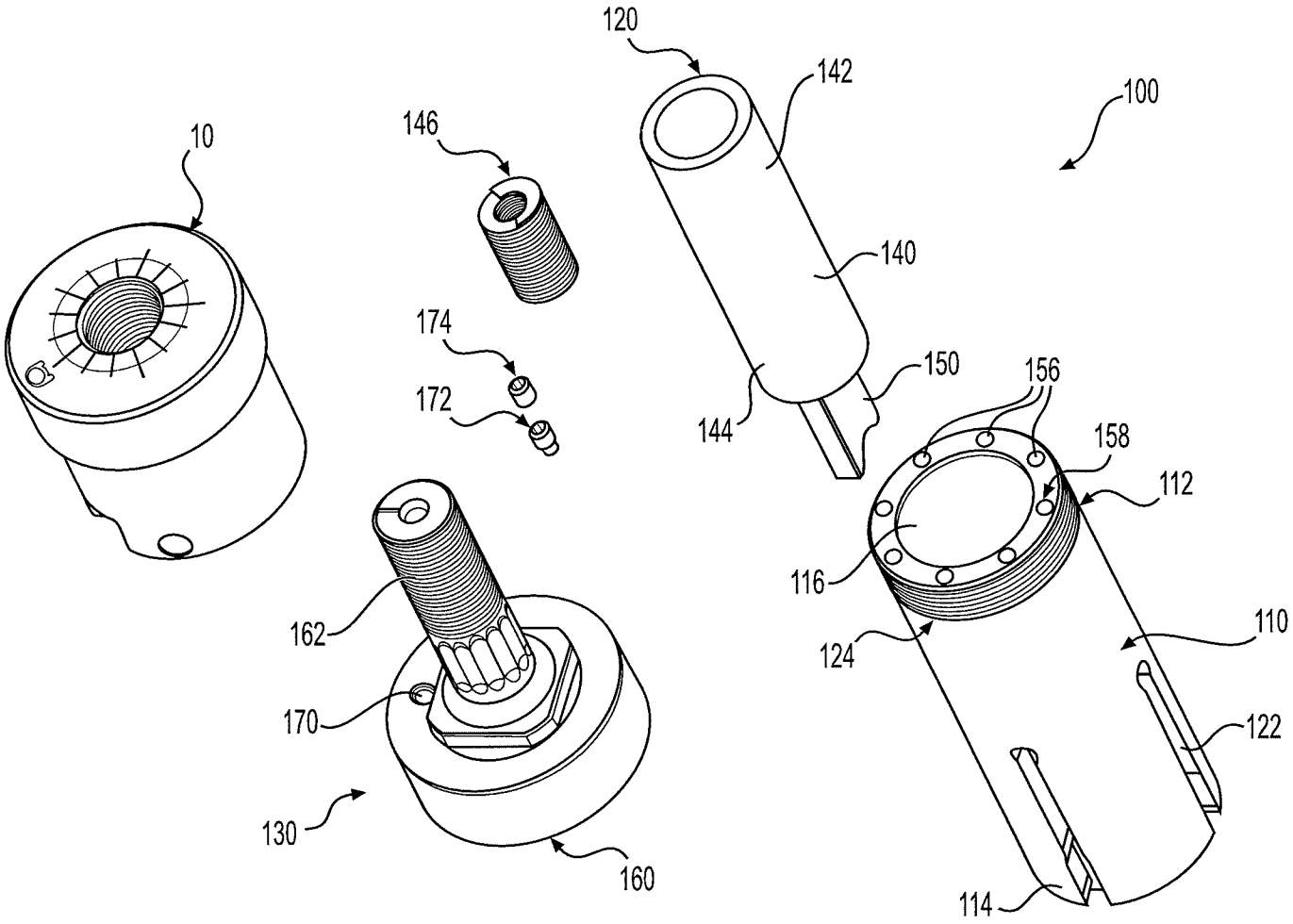
FIG. 1 is an exploded top perspective view of a punch body assembly according to an exemplary embodiment of the present invention.

Referring to FIGS. 1-4, the present invention relates to a punch body assembly 100 for a punching tool and method of adjusting the same. The punch body assembly 100 is designed to allow easy in-field adjustment of the length of the punching tool, particularly as the tool wears down. The punch body assembly 100 according to an exemplary embodiment of the present invention generally includes a punch body 110 that retains an ejector member 120 and engages a driver 130. The adjustment mechanism of the present invention, discussed in detail below, allows for adjusting the axial position of the driver 130 with respect to the punch body 110, that is adjusting the axial distance between the driver 130 and the punch body 110, to lengthen the tool such as when its wears down from use. This allows the end user to re-surface the face of the punch body 110 while keeping the ejector member 120 at its same setting in the punching machine. The driver 130 preferably engages a punch head 10, such as the punch head disclosed in commonly assigned patent application Ser. No. 15/479,028 entitled Adjustable Punch Head Assembly, filed concurrently herewith, the subject matter of which is herein incorporated by reference.

Punch body 110 provides a cutting function for the punching tool. Punch body 110 includes a driver engagement end 112, opposite cutting end 114, and a longitudinal inner bore 116 extending therebetween. Punch body 110 may have a generally cylindrical shape. Inner bore 116 includes an inwardly extending shoulder 118 (FIG. 4) that supports the ejector member 120. One or more elongated slots 122 may be provided in punch body 110 that provide a key for aligning punch body assembly 100 with a punching machine. Each elongated slot 122 preferably extends from about the middle of punch body 110 to the cutting end 114 thereof. A number of the elongated slots 122 may be annularly spaced from one another around the punch body 110.

The driving engagement end 112 of punch body 110 has an adjustable engagement 124 for mating with driver 130. Adjustable engagement 124 may be any type of engagement mechanism that allows adjustability of the axial length between punch body 110 and driver 130. For example, adjustable engagement 124 may be external threads at the punch body's driving engagement end 112, as seen in FIG. 1.

Figure 4:
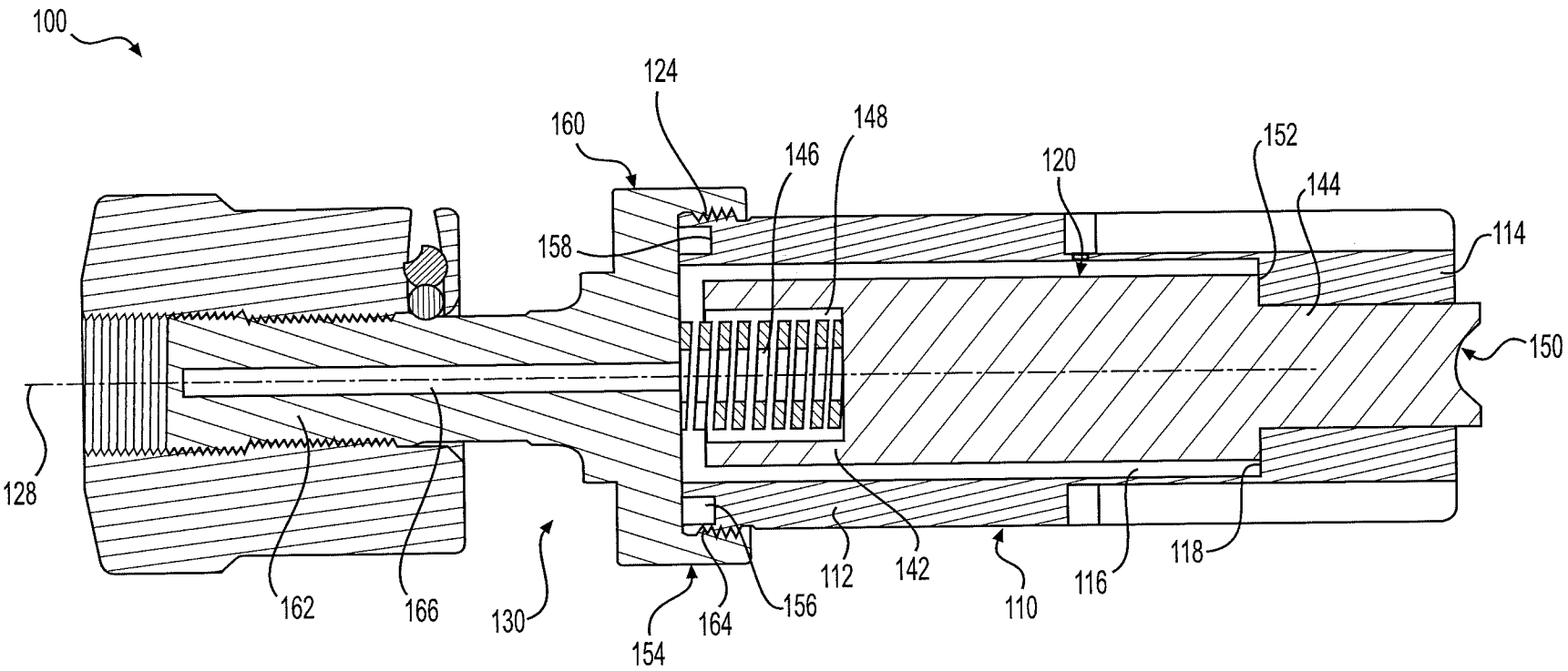
FIG. 4 is a cross-sectional view of the punch body assembly illustrated in FIG. 3.

The ejector member 120 is supported by punch body 110 in its inner bore 116 inside of punch body 110, as best seen in FIG. 4. Ejector member 120 may be an ejector pin that has a body 140 with opposing ends 142 and 144. End 142 of ejector member 120 is preferably spring biased by a spring 146 disposed in the punch body's inner bore 116 between end 142 and driver 130, as seen in FIG. 4. The ejector member's end 142 may have a cavity 148 that accommodates at least of portion of spring 146. The other end 144 of ejector member 120 has an ejector extension 150 that extends through the cutting end 114 of punch body 110 for ejecting a punched part. Ejector extension 150 preferably has a smaller diameter that the rest of the ejector member's body 140, thereby defining an outer shoulder 152 which can abut the inwardly extending shoulder 118 when ejector member 120 is installed in punch body 110.

Figure 3:
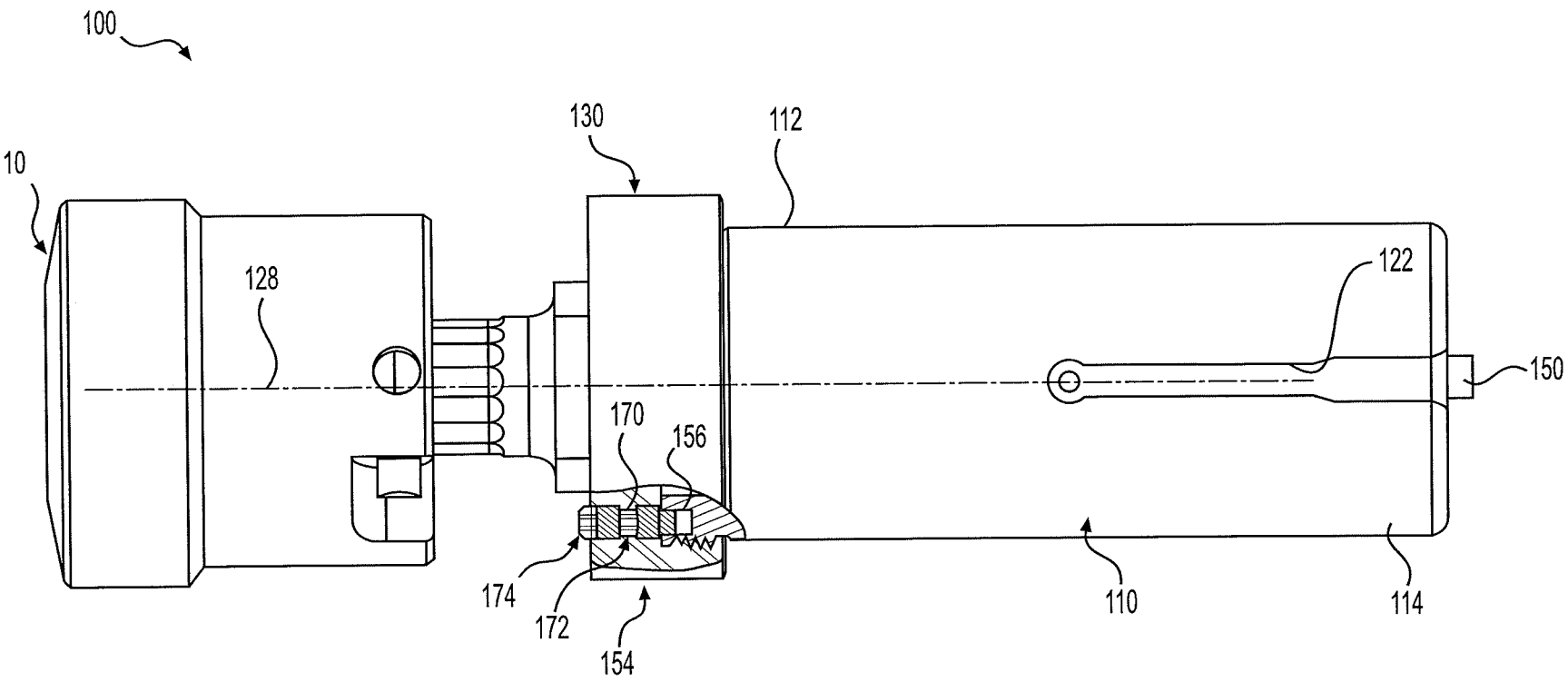
FIG. 3 is a side elevational view of the punch body assembly illustrated in FIG. 1, showing a portion thereof cut away.

A locking mechanism 154 (FIGS. 3 and 4) may be provided at the driving engagement end 112 of punch body 110 for locking driver 130 to punch body 110, and preferably to lock in the axial position of driver 130 with respect punch body 110 along its longitudinal axis 128 (FIG. 3). Locking mechanism 154 may include one or more position bores 156 disposed in the end face 158 of the punch body's driver engagement end 112. In a preferred embodiment, a plurality of position bores 156 are annularly arranged on end face 158 around the opening to the punch body's inner bore, as best seen in FIG. 1.

Figure 2:
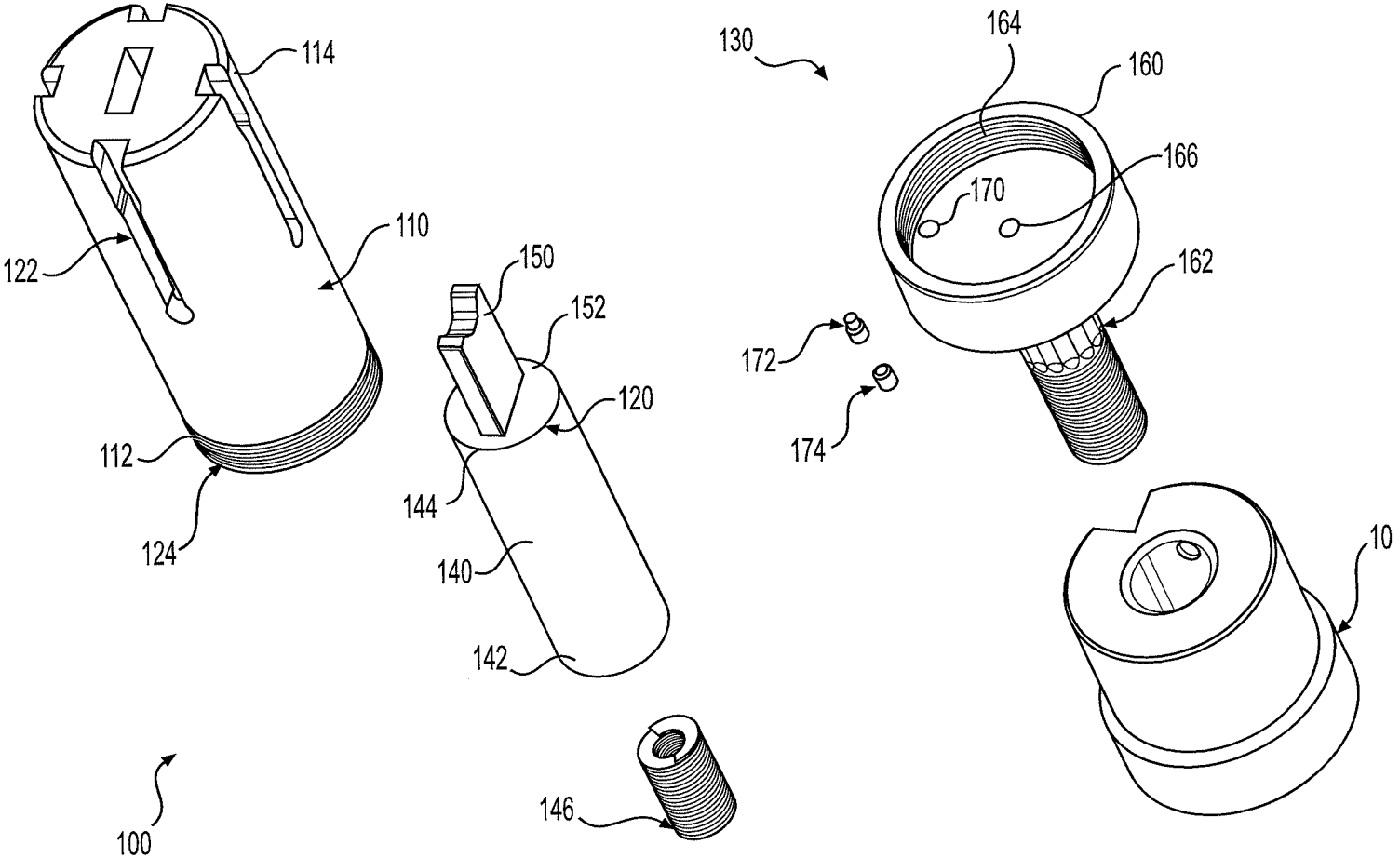
FIG. 2 is an exploded bottom perspective view of a punch body assembly illustrated in FIG. 1.

Driver 130 is configured to rotatably and adjustably couple to the driver engagement end 112 of punch body 110. Driver 130 generally includes a base 160 that engages punch body 110 and a stem 162 extending therefrom that engages the punch head 10. A central bore 166 may be provided that extends through stem 162 and base 160. Central bore 166 allows air or oil mist to pass through the tool to the outer diameter of punch body 110 for keeping the tool lubricated in the punching machine. Base 160 preferably includes an adjustable engagement 164 that cooperates with adjustable engagement 124 of punch body 110 to adjust the axial position of driver 130 with respect to punch body 110 on longitudinal axis 128 when needed. Adjustable engagement 164 may be internal threads adapted to engage the external threads of adjustable engagement 124 of punch body 110. In a preferred embodiment, the internal threads of adjustable engagement 164 are located in the bottom of the base 160, as best seen in FIGS. 2 and 4. The end face 158 of punch body 110 is received in the bottom of base 160 allowing engagement of the internal and external threads. Although a threaded engagement between driver 130 and punch body 110 is preferred, adjustable engagements 124 and 164 may be any engagement mechanism that allows adjustment of the axial position of driver 130 with respect to punch body 110.

By rotating driver 130 with respect to punch body 110, the distance between the driver's base 160 and the driver engagement end 112 of punch body 110 can be increased or decreased via threads of the adjustable engagements 124 and 164, thereby establishing an axial position of driver 130 on longitudinal axis 128. Once the desired axial position of driver 130 is selected, that selected axial position of driver 130 can be locked in via locking mechanism 154. In a preferred embodiment, locking mechanism 154 includes at least one locking hole 170 that extends through the base 160 of driver 130. Locking hole 170 is configured to align with one of the position bores 156 of punch body 110. The driver 130 may be rotated with respect the punch body 110 until the locking hole 170 aligns with one of the position bores 156. A fastener 172 may be inserted in the aligned locking hole 170 and the one of the position bores 156 to locking the axial position of the driver 130 with respect to punch body 110. Fastener 172 may be a set screw, for example. For safety, a second fastener 174, such as another set screw, may be provided that cooperates with the first fastener 172. Use of more than one fastener reduces the chance of the fasteners becoming loose from driver 130 and punch body 110.

The method of adjusting the punch body assembly 100 according to the present invention comprises the steps of coupling base 160 of driver 130 to driver engagement end 112 of the punch body 110; rotating driver 130 with respect to the punch body 110 until a select axial position of driver 130 with respect to the punch body 110 is reached along the longitudinal axis 128 of the punch body 110; and locking the select axial position of driver 130. The step of coupling driver 130 to the punch body includes threadably coupling the base 160 of driver 130 to driver engagement end 112 of the punch body 110.

The method may further include the steps of rotating driver 130 with respect to the punch body 110 to the select axial position any aligning one of the plurality of position bores 156 in driver engagement end 112 of the punch body 110 with locking hole 170 in the base 160 of driver 130 and locking the select axial position of driver 130 by inserting at least one fastener 172 through locking hole 172 and through the one of plurality of position bores 156 aligned with locking hole 170.

To change or adjust the driver's axial position, the method of the present invention may also include the steps of unlocking the select axial position of the driver 130 by removing fastener 172; rotating driver 130 with respect to the punch body 100 until another axial position of the driver with respect to the punch body is reached along the longitudinal axis 128; and then locking the driver 130 in the second select axial position be re-inserting the fastener 172.

While a particular embodiment has been chosen to illustrate the invention, it will be understood by those skilled in the art that various changes and modifications can be made therein without departing from the scope of the invention as defined in the appended claims.

What is claimed is:

1. Method of adjusting a punch body assembly comprising a punch body coupled to a driver, comprising the steps of:

coupling a base of the driver to a driver engagement end of the punch body;

moving the driver with respect to the punch body until a select axial position of the driver with respect to the punch body is reached along a longitudinal axis of the punch body;

locking the driver at the select axial position, and wherein the step of moving the driver with respect to the punch body to the select axial position includes aligning one of a plurality of position bores in the driver engagement end of the punch body with a locking hole in the base of the driver.

2. The method of claim 1, further comprising the steps of unlocking the select axial position of the driver; and rotating the driver with respect to the punch body until another select axial position of the driver with respect to the punch body is reached along the longitudinal axis.

3. The method of claim 2, further comprising the step of locking the driver in the another select axial position.

4. The method of claim 1, wherein the step of coupling the driver to the punch body includes threadably coupling the base of the driver to the driver engagement end of the punch body.

5. The method of claim 1, wherein the step of moving the driver with respect to the punch body comprising rotating the driver with respect to the punch body to the select axial position.

6. The method of claim 1, wherein the plurality of position bores are arranged annularly around an end face of the driver engagement end of the punch body.

7. The method of claim 1, wherein the step of locking the driver at the select axial position includes inserting at least one fastener through the locking hole and into the one of plurality of position bores aligned with the locking hole.

8. The method of claim 7, further comprising the step of unlocking the select axial position of the driver by removing the fastener from the locking hole.

9. The method of claim 8, further comprising the step of, after the step of unlocking the select axial position of the driver, rotating the driver with respect to the punch body until another select axial position of the driver with respect to the punch body is reached along the longitudinal axis of the punch body.

10. The method of claim 9, wherein the step of rotating the driver with respect to the punch body to the another select axial position includes aligning another one of the plurality of position bores in the driver engagement end of the punch body with the locking hole in the base of the driver.

11. The method of claim 10, further comprising the step of locking the driver at the another select axial position by inserting at least one fastener through the locking hole and through the another one of the plurality of position bores.

12. The method of claim 1, wherein an ejector member is retained by the punch body, the ejector member has a body that is spring biased at one end and has an ejector extension at the other end.

13. The method of claim 1, further comprising the step of aligning a cutting end of the punch body that is opposite of the driver engagement end with a punching machine.

14. A method of adjusting a punch body assembly comprising a punch body coupled to a driver, comprising the steps of:

threadably coupling a base of the driver to a driver engagement end of the punch body, the base having at least one locking hole and the driver engagement end having a plurality of position bores;

rotating the driver with respect to the punch body until the locking hole aligns with one of the plurality of position bores thereby establishing a select axial position of the driver with respect to the punch body and along a longitudinal axis of the punch body; and locking the driver in the select axial position.

15. The method of claim 14, wherein the step of threadably coupling the driver and the punch body includes coupling internal threads of the base of the driver with external threads of the driver engagement end of the punch body.

16. The method of claim 14, wherein the step of locking the driver in the select axial position includes inserting at least one fastener through the locking hole and into the one of the plurality of position bores that is aligned with the locking hole.

17. The method of claim 16, further comprising the step of unlocking the select axial position of the driver by removing the fastener from the locking hole.

18. The method of claim 16, further comprising the steps of, after the step of unlocking the select axial position of the driver, rotating the driver with respect to the punch body until the locking hole aligns with another one of the plurality of position holes to establish another select axial position of the driver with respect to the punch body along the longitudinal axis thereof; and locking the driver in the another select axial position.

19. The method of claim 18, wherein the step of locking the driver in the another select axial position includes inserting at least one fastener through the locking hole and into the another one of the plurality of position bores aligned with the locking hole.

* * * * *